US005619179A

United States Patent [19]

Smith

[11] Patent Number: 5,619,179

[45] Date of Patent: Apr. 8, 1997

[54] METHOD AND APPARATUS FOR ENHANCING ELECTRONICALLY GENERATED SOUND

[75] Inventor: Blaine Smith, Lincoln City, Oreg.

[73] Assignee: Sharper Image Corporation, San Francisco, Calif.

[21] Appl. No.: 332,567

[22] Filed: Oct. 31, 1994

[51] Int. Cl.[6] ..... G08B 3/10

[52] U.S. Cl. ..... 340/384.72; 340/384.71; 340/384.3; 446/404; 446/484

[58] Field of Search ..... 340/384.72, 384.7, 340/384.3, 384.71; 446/404, 408, 484

[56] References Cited

U.S. PATENT DOCUMENTS

| | | | |
|---|---|---|---|
| 3,871,112 | 3/1975 | Licitis | 446/408 |
| 4,086,589 | 4/1978 | Cieslak et al. | 340/384.72 |
| 4,363,028 | 12/1982 | Bosnak | 340/384.72 |
| 4,401,975 | 8/1983 | Ferguson et al. | 340/384.72 |
| 4,558,305 | 12/1985 | Black et al. | 340/384.72 |
| 5,145,447 | 9/1992 | Goldfarb | 446/408 |
| 5,382,188 | 1/1995 | Tomellini | 446/484 |

*Primary Examiner*—Jeffery Hofsass
*Assistant Examiner*—Daniel J. Wu
*Attorney, Agent, or Firm*—Flehr, Hohbach, Test, Albritton & Herbert

[57] ABSTRACT

A sound generator includes independent and identical generators for the left and right sound channels. In one embodiment, identical sound synthesizer ICs contain the same library of sound loops. By retarding one IC's RESET port, the two ICs will always begin to output sound at slightly different times. If both ICs are clocked at the same clock rate, a fixed time shift between the left and right channel loops produces a pseudo-stereo effect. If the ICs are clocked at slightly different rates, the time shift between channels can drift continuously, producing the effect of migrating sound having great depth and spatial separation. In a second embodiment, substantially identical white noise generators output the left and right sound channels. In one mode, a common sawtooth waveform modulates each channel producing a wide variation in pulsating wave sounds. In another mode, the user may manually modulate both channels. A preferred embodiment provides a sound generator that uses two synthesizer ICs and two white noise generators.

20 Claims, 7 Drawing Sheets

METHOD AND APPARATUS FOR ENHANCING ELECTRONICALLY GENERATED SOUND

FIELD OF THE INVENTION

The present invention relates generally to electronic generation of sound, and more specifically to methods and apparatuses that enhance apparent spatial separation of such sound.

BACKGROUND OF THE INVENTION

Electronic sound generators are often used for personal entertainment, recreation, relaxation and even to promote sleep. Users of such equipment find the sound of rain, falling water, wind, among other natural sounds, to be especially beneficial. The sounds may be used to mask out excessively loud and distracting ambient noise, to soothe the user, and even to help the user fall asleep.

Electronic sound generators usually can create several such sounds, and include a switch permitting user-selection of a particular sound. The generators also provide controls for volume and even to permit the user to modulate the effects of some of the sounds.

Some electronic sound generators output synthesized sounds. The nature or other sounds will first have been tape recorded, and a digitized representation of the recorded sounds are then electronically stored in a synthesizer integrated circuit ("IC"). The IC is then used in an electronic sound generator to output the user-selected synthesized stored sounds for listening.

Other electronic sound generators do not store sounds, but simulate sounds using white noise. Ideally, a "white noise" generator outputs a wide spectrum of frequencies, each frequency component being of equal amplitude. Sounds associated with running or rushing water, for example, may be readily simulated using a white noise generator. The amplitude of the white noise is often modulated, or changed, using a ramp signal. When the instantaneous magnitude of the ramp varies, the magnitude of the white noise sound will be varied. A control can permit the user to vary varying the rate at which the ramp changes amplitude to produce interesting sound effects from white noise electronic sound generators.

Whether generated from a single digital synthesizer IC, or from a single white noise source, electronic sound generators present the sound to left and right channel speakers or earphones. This can somewhat improve the sound quality perceived by the user, but nonetheless there is considerable room for improvement. The sounds often sound too "flat", with too little perception of sound depth or quality.

Also the somewhat limited repertoire of sounds available from most electronic sound generators can cause the user to become bored with the equipment. The sound patterns simply become too repetitious to be long enjoyed.

In some sound generators, variations in the sounds heard may occur too abruptly. Portions of an ocean wave sound, for example, may transition too abruptly from a quiet and calm wave sound to a loud rushing wave sound. The sensation can be a soft-loud-soft-loud repetitive pattern that is annoying to the user. In fact, some sound patterns that are too repetitively abrupt are believed to trigger seizures in epileptics.

In summation, there is a need for an electronic sound generator that can produce sounds having more perceived sound depth, and improved sensation of spatial separation between channels. Such generator should provide a greater variety of sound sensations, including the ability for the user to create new and continuously varying sound patterns.

The present invention discloses such an electronic sound generator.

SUMMARY OF THE INVENTION

In a first embodiment, digitally synthesized sounds are generated from identical first and second synthesizer integrated circuits ("ICs"), each IC outputting sound to a left or right channel. Permanently stored within each IC is an identical library of digitally recorded continuous sound loops. When not in a RESET mode, each IC outputs one of its stored sound loops at a rate proportional to the IC clock rate. The first IC has its RESET port retarded relative to the RESET port of the second IC by a time ΔRESET. As a result, upon exiting RESET, the start of a recorded sound loop output from the second IC will occur before the start of a recorded sound loop from the first IC. A user-controlled library selection switch allows both ICs to output the same or a different loop of digitally recorded sounds the stored library.

In a LOCK mode, the first and second ICs are clocked at a common clock rate. When the user causes each IC to output the same loop of recorded sound, a fixed spatial offset results because the second IC will begin to output its sound loop before the RESET-retarded first IC can begin to output its loop. This offset between the left and right channels produces an interesting pseudo-stereo effect.

An even more interesting effect occurs in an UNLOCK mode, wherein the ICs are clocked at slightly different clock rates, especially when the user selects the same sound loop to be output by each IC. As in the LOCK mode, the second IC will begin to output its sound loop before the first IC begins to output. However, the relative offset in time between the same point in each of the identical sound loops can vary continuously because each IC is now clocked at a slightly different rate. A continuously varying sound pattern is generated. As the relative time offset between the loops drifts, the resultant pseudo-stereo sound may appear to emanate in one ear, then migrate through the center of the user's skull, at which time the two sound loops have no offset and present a monaural sound. As the two loops continue to drift in relative time offset, further sound "migration" occurs, and the sound will eventually seem to emanate in the other ear, and then revert to a pseudo-stereo sound.

In a second embodiment, an electronic sound generator includes two substantially identical white noise generators that output sound for the left and right channels. A WAVE/RAIN switch permits the user to select either a sawtooth modulation envelope for both channels, or a manually controlled envelope for both channels. IF WAVE is selected, a potentiometer control allows the user to vary the modulation repetition rate over an approximately 100:1 range, which produces a wide variation in the output wave sounds. If RAIN is selected, the same potentiometer control now is used to manually modulate the envelope of the two channels. Sounds ranging from a light rain to a lower frequency waterfall may be produced.

The two embodiments may be combined into a single electronic sound generator, with the left channel from the digital sound IC and the white noise generator combined, and likewise for the right channels. The use of two identical ICs and/or noise generators can produce truly surprising spatial and sound depth responses, and new and continuously varying patterns of sound. Further, by combining all of the sounds, the white-noise generated wave sound may be heard along with IC-generated ocean sounds to produce still new combinations of sound.

Other features and advantages of the invention will appear from the following description in which the preferred embodiments have been set forth in detail, in conjunction with the accompanying drawings.

DETAILED DESCRIPTION OF THE PREFERRED EMBODIMENTS

Figure 1B:
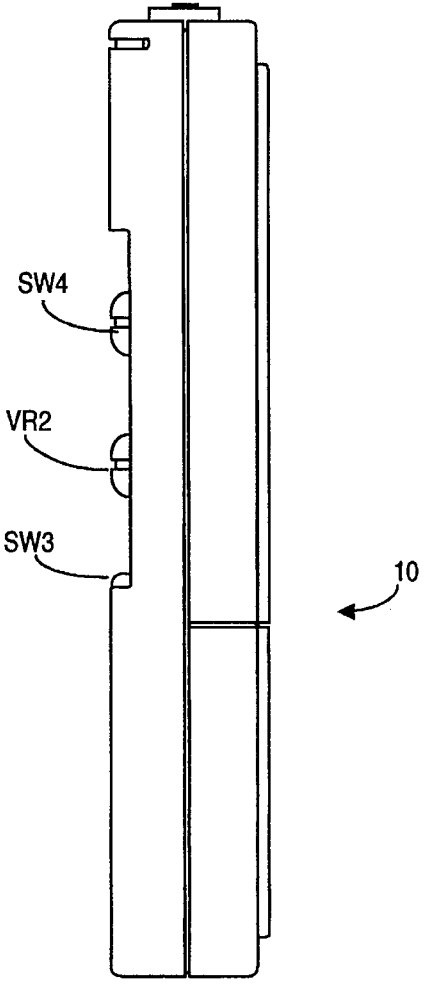
FIG. 1B is a sideview of the hand-held sound generator unit of FIG. 1A.
Figure 1A:
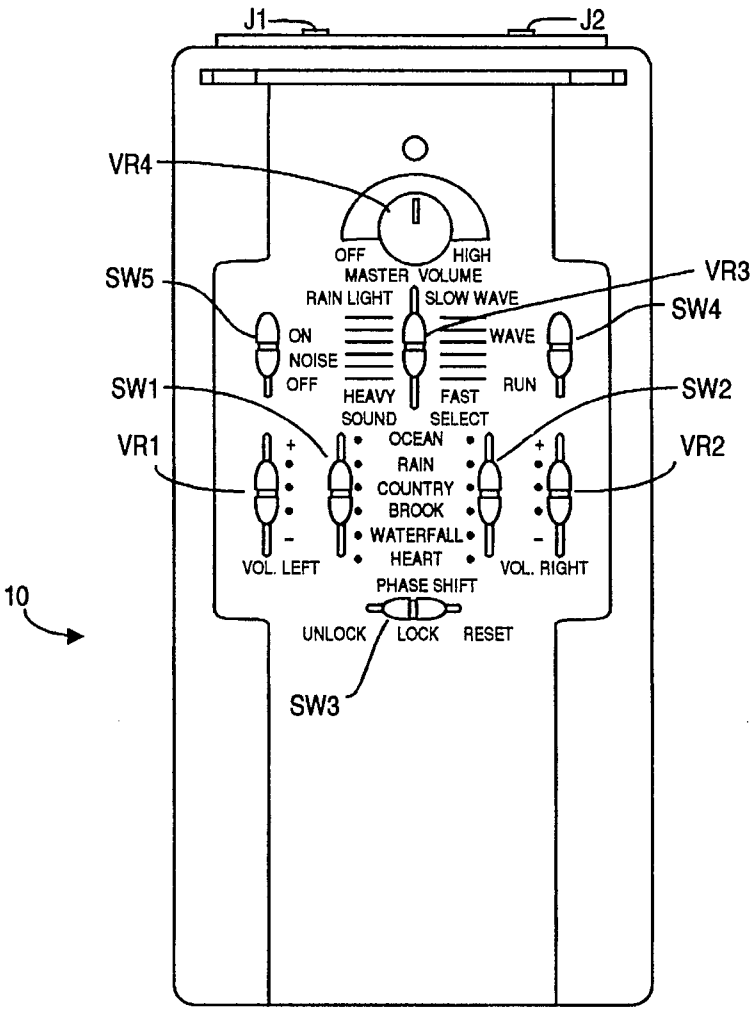
FIG. 1A is a front view of a hand-held enhanced sound generator unit incorporating phase shiftable digital sound generators, and modulatable noise sound generators, according to the present invention.

FIGS. 1A and 1B depict a hand-held enhanced sound generator unit 10, according to the present invention. As indicated by FIG. 1A, unit 10 outputs left and right channels of audio through a stereo jack J2. Within unit 10, all of the left channel signals generated by unit 10 (or provided through optional jack J1) are summed together, as are all right channel signals. The combined left-channel and combined right-channel signals are output to jack J2. Potentiometer VR4 acts as a master volume control for all of summed-together left channel and right channel audio and is coupled to a power ON/OFF switch for unit 10. Stereo earphones (not shown) are connected to jack J2, which permits a user to listen to the generated audio, and/or to an external source of audio, e.g., a CD player, optionally provided to stereo jack J1.

As will be described more fully below, unit 10 includes two independent digital sound generator units that store and output a variety of sounds that may be user-selected with switches SW1 and SW2. In the preferred embodiment, the library of stored sounds include the sound of the ocean, of falling rain, the countryside, a brook, a waterfall, and the sound of a heart beating. Any of the sounds may be selected and heard at either audio channel at a volume controlled by potentiometers VR1 and VR2. For example, SW1 and SW2 might be selected to produce a BROOK sound in the left ear and RAIN sound in the right ear. These two sounds will be heard along with any noise-generation sounds provided by unit 10, and with any externally generated sounds input to jack J1. The audio effect can be very soothing and relaxing to a user.

Phase shift switch SW3 permits the user to listen to no synthesized sound (RESET mode), to a pseudo-stereo sound (LOCKED mode), or to sound having a greatly enhanced spatial separation, or depth of quality (UNLOCKED mode). In the UNLOCKED mode, the user can hear sounds that appear to slowly migrate from one ear, through the skull, and into the other ear. The migrating sounds continuously vary in their patterns of repetition.

Unit 10 also includes two independent noise generators whose signals are modulated by a common modulator. Switch SW4 permits the user to determine whether the noise audio shall sound like a wave, or like rain. Potentiometer VR3 permits the user to control the nature of the wave or rain sound. Switch SW5 permits the user to disconnect the outputs from the noise generators from the remainder of unit 10.

Figure 2:
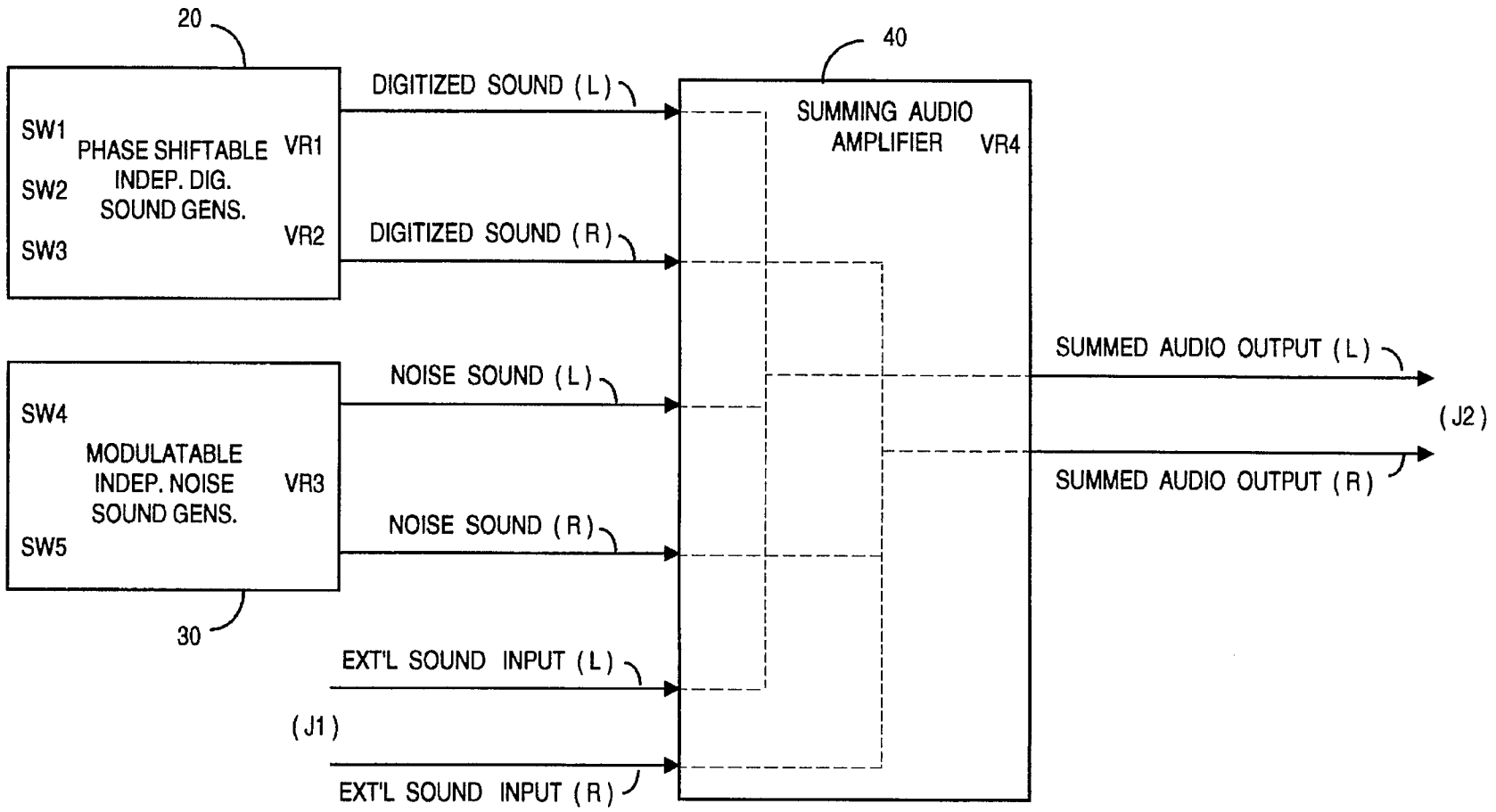
FIG. 2 is a block diagram of an enhanced sound generator unit, according to the present invention.

With reference to FIG. 2, unit 2 may be considered as comprising three modules, modules 20, 30 and 40. Module 20 provides two phase shiftable independent digital sound generators. Associated with module 20 are user-controlled switches sound selection switches SW1 and SW2, and phase shift switch SW3. Module 20 also provides volume controls VR1 and VR2 that determine the volume of the two channels of digitized sound output by module 20 to the summing audio amplifier module 40.

Module 30 in FIG. 2 provides modulatable independent noise sound generators, for which switch SW4 enables the user to select a rain or wave sound whose characteristics may be controlled by potentiometer VR3. The left and right channels of noise sound from module 30 are provided as further inputs to the summing audio amplifier module 40.

The summing audio amplifier module 40 adds together all of the left channel inputs, e.g., from modules 20 and 30 and (if present) external audio from input jack J1, and all of the right channel inputs. The summed-together left channel signals and the summed-together right-channel signals are amplified and output at stereo jack J2. A master volume control potentiometer VR4 permits user adjustment over all audio signals passing through module 40. As noted, stereo earphones will be coupled to jack J2.

Figure 3A:
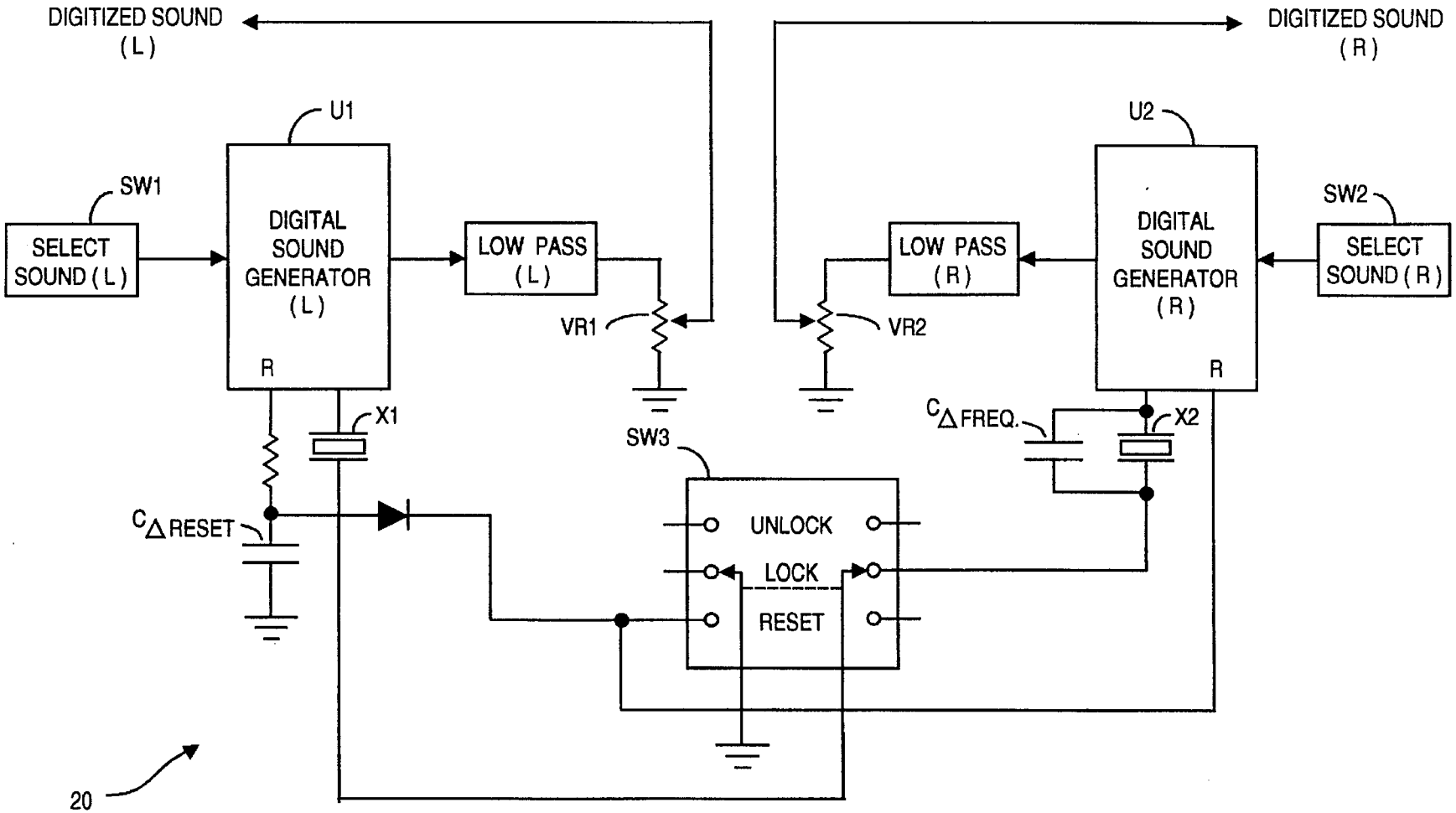
FIG. 3A is a block diagram of a dual-output phase-shiftable digital sound generator, according to the present invention.

FIG. 3A provides a more detailed block diagram of module 20, e.g., the phase shiftable independent digital sound generators. Module 20 contains two independent digital sound generators, U1 and U2. U1 and U2 are manufactured to digitally store identical sounds that were prepared by applicant. The library of digitally stored sounds are those sounds selected for output by the user with switches SW1 and SW2, e.g., ocean, rain, country, etc. The sounds are stored as continuous loops, with the loop duration depending upon the sound. For example, the OCEAN sound is an 11 second loop, whereas the RAIN sound is a 5 second loop. The selected loop will be continuously generated as long as the sound generators are not in a RESET mode.

As used herein, generators U1 and U2 are termed "phase shiftable" because module 20 can vary the time difference between a portion of the audio loop output by generator U1, and the occurrence of the same portion in the audio loop output by generator U2. A zero phase shift (or digital phase shift) means the same portion of the sound loop output by U1 and the sound loop output by U2 is exactly coincident in time. A 50% digital phase shift means that the start of one of the sound loops is delayed in time 50% of the loop length from the start of the other sound loop. Thus, if U1 and U2 each output the OCEAN sound, a 50% digital delay means there is a 5.5 second lag (e.g., 50% of the 11 second recorded loop length) between the same portions of each of the output signals.

As shown in FIG. 3A, the digital sounds output by U1 and U2 are low pass filtered, are volume-controlled by VR1 and VR2 and are passed to the summing audio amplifier module 40.

Resonators X1 and X2 control the clock rate of sound generators U1 and U2 respectively. Although resonators X1 and X2 are identical, the frequency of resonator X2 is purposely slowed somewhat with capacitance, shown generically as $C_{\Delta FREQ}$.

When SW3 is placed in the LOCK position (as shown in FIG. 3A), U1 and U2 will both be clocked at an identical clock rate since X1 and X2 will oscillate in a sympathetic mode. However when SW3 is in the UNLOCK position, X1 will clock U1 more rapidly than will X2 clock U2. Thus, in the UNLOCK mode, even if U1 and U2 are to output identical sounds (as commanded by switches SW1 and SW2), the nature of the sounds will be somewhat different due to the differential clock rate.

Each sound generator U1 and U2 includes a RESET port, shown generically in FIG. 3A as pin R. When the voltage at this port falls below a threshold, no sound is output by the sound generator. Thus, when SW3 is in the RESET mode, each reset port R will be below the threshold needed for normal sound generation.

Assume now that SW3 is taken out of the RESET mode, e.g., into the LOCK or the UNLOCK mode. The voltage at pin R on U2 will rapidly rise to a level permitting U2 to commence normal sound generation. However, the voltage at pin R on U1 is intentionally caused to rise more slowly by adding capacitance, shown generically as $C_{\Delta RESET}$. As a result, upon leaving the RESET mode, U2 will always output the start of its stored loop before U1 begins to output the start of its stored loop. This time differential in exiting RESET mode will be referred to as ΔRESET.

Due to this intentional RESET time differential, when SW3 is in the LOCK position a pseudo-stereo sound will be created when SW1 and SW2 cause U1 and U2 to respectively output the same type signal, e.g., ocean and ocean, rain and rain, etc. Although U1 and U2 are both switched to output the same sound (e.g., ocean-ocean), U1 will exit RESET more slowly than U2, due to the retarding effect of $C_{\Delta RESET}$. Thus although U1 and U2 will output identical sounds, U1 will output its sound slightly later in time than U2. The resultant fixed phase shift creates a pseudo-stereo sound.

A more interesting phenomenon occurs when SW3 is in the UNLOCK position and SW1 and SW2 select identical type signals. In this mode, U1 and U2 output the same sound, but U1's output is provided at a slightly faster clock rate relative to U2, because $C_{\Delta FREQ}$ slows X2 relative to X1. The differential clock rate causes a slight difference in the character of the two sounds. In addition, U1 will exit RESET more slowly than U2, which means the U2-stored loop will first begin to be output, and after a differential RESET delay, U1 will also exit RESET and the U1-stored loop will begin to be output. The result is that U1 lags U2, and because X1 and X2 clock U1 and U2 at slightly different frequencies, a continuous drifting in digital phase occurs between the audio output by U1 and U2.

In UNLOCK, the relative phase shift between output signal from the faster-clocked U1 drifts relative to the output signal from U2. Soon a user will experience the sensation that the sound seems to emanate from one ear. As the relative phases continue to drift, the U1 output will "catch-up" with and be precisely in-phase with the U2 output. When this occurs, the resultant monaural sound will appear to be emanating from the center of the user's skull.

As the phases continue to drift, the sound will appear to migrate to the other ear. The sound will then revert to pseudo-stereo, with a continuously changing sound pattern being heard in both ears. The depth of the resultant sound is truly surprising. The repetition rate of the migrating sensation is a function of the recorded sound loop length, and how fast the U1 and U2 sounds are drifting. Shorter loops such as the HEART and FALLS sounds will produce a faster repetition than will longer loop sounds such as OCEAN.

In the UNLOCK mode, a continuously varying pattern of sounds is heard. For example, if the digitally recorded signal had a characteristic sound, perhaps a loud "gurgle" in the middle of the five second BROOK sound loop, the "gurgle" will seem to repeat with different repetition rates. When the U1 and U2 BROOK sounds have a relatively phase shift of say 2.5 seconds, the "gurgle" sound will be heard at intervals of 2.5 seconds. When the U1 and U2 sounds have drifted into coincidence, e.g., monaural sound, a single "gurgle" sound will be heard every 5 seconds. The UNLOCK mode may of course be used with different U1, U2 sounds selected by SW1, SW2. However because the two sounds are different (e.g., OCEAN and HEART), they can never be coincident, and the drifting-migrating effect described above will not be created.

Figure 3B:
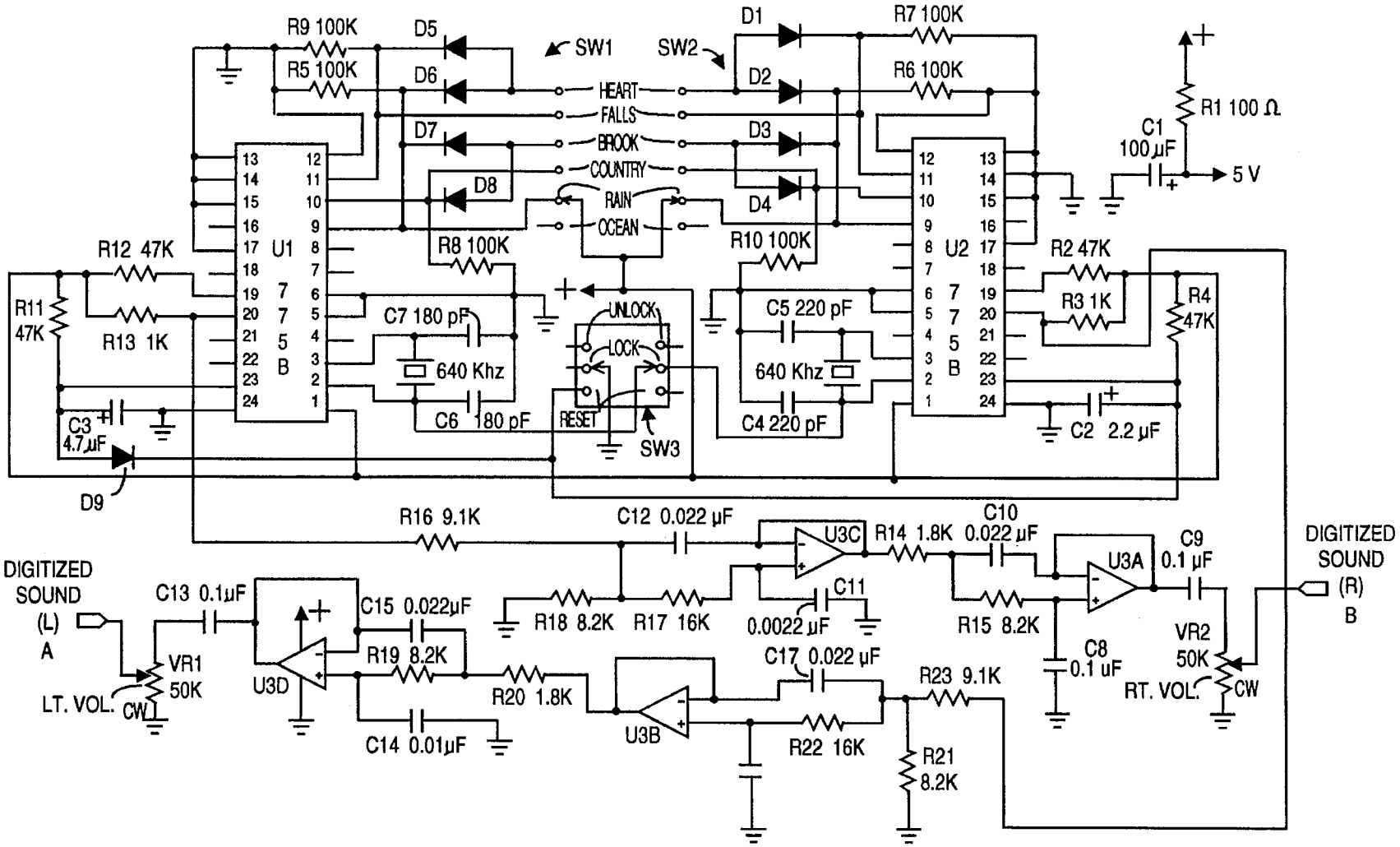
FIG. 3B is a schematic diagram of a preferred embodiment of a dual-output phase-shiftable digital sound generator, according to the present invention.

FIG. 3B is a schematic of a preferred implementation of module 20. Sound generators U1 and U2 preferably are NEC 7758 integrated circuits whose internal read only memory has been mask-dedicated by NEC to store sound patterns produced by applicant. The sound patterns are digitized within U1 and U2 using adaptive pulse code modulation with an 8 KHz sample rate. In the preferred embodiment, some stored sound patterns intentionally contain background noise so that sound is always present.

Further, when the sounds were originally recorded, they were edited to match the peak-peak magnitude at the start and at the end of the recorded loop. This ensures that when the sounds are later stored in U1 and U2 and are played back, the loop will sound continuous without a perceptible transient between loop end and loop start. An NEC NV300 development system was used to prepare the sounds that were eventually stored in U1 and U2.

U1 and U2 are coupled to 650 KHz resonators X1 and X2, respectively. However, as noted in FIG. 3B, X2 sees more capacitance (C4, C5 220 pF) than is seen by X1 (C6, C7, 180 pF). As a result, X2 will oscillate at a slightly lower frequency, perhaps a few Hz to a few KHz lower, than X1 although the frequency differential is not critical.

U1 and U2 will output sound as long as they are not in the RESET mode, in which mode normal output ceases. RESET occurs when the voltage coupled to pins 23 of U1 and U2 is less than a threshold equal to about 50% of the $V_{CC}$ power source voltage. ($V_{CC}$ nominally is perhaps +6 VDC.) As long as pin 23 of U1 is at a sub-threshold potential, U1 remains RESET, and as long as pin 23 of U2 is at a sub-threshold potential, U2 will remain RESET. While in the RESET mode, the various digital counters within U1 and U2 are reset, and although resonators X1 and X2 continue to oscillate, U1 and U2 do not output signals. RESET mode is entered by the user moving SW3 into the RESET position. It is apparent from FIG. 3B that as long as SW3 remains in the RESET position, the voltage at pin 23 of U1 cannot exceed approximately 0.7 VDC (due to the presence of diode D9), and the voltage at pin 23 of U2 will be 0 VDC, e.g., ground. Once SW3 is switched from RESET to LOCK or UNLOCK, the voltages at pin 23 of U1 and U3 will each begin to rise.

As was noted in FIG. 3A, the voltage at reset pin 23 on U1 is caused to rise more slowly than the voltage at pin 23 on U2. In FIG. 3B, it is seen that reset capacitor C3 (4.7 μF) coupled in shunt across pin 23 of U1 is larger in magnitude than C2 (2.2 μF), which is coupled in shunt across pin 23 of U2. This capacitance differential causes U1 to always exit RESET mode more slowly than U2, the time differential ΔRESET being perhaps 100 ms in the preferred embodiment.

Because U1 thus lags U2, when exiting RESET mode, the start of the sound loop generated by U1 will always be offset in time behind the start of the sound loop generated by U2. This offset can produce pseudo-stereo and other interesting sound-enhancing and spatially-separating effects.

The preferred embodiment intentionally inserts the RESET time lag on the faster-clock generator U1 (assuming UNLOCK mode is being used). When unit 10 is first turned-on, and switched from RESET to UNLOCK mode, after a time period of perhaps 10 seconds to 30 seconds, the above-described sound "migration" may be heard. This empirically predictable occurrence enables one to readily demonstrate the migration effect provided by unit 10 to a user and potential purchaser of the unit.

The approximately 10 to 30 second delay in onset of the "migration" effect is a function of the frequency differential between X1 and X2, and of the differential RESET time delay. This 10 to 30 second delay is how long it takes for U1 and U2 to go from-a nominal 100 ms or so RESET time delay to zero ms delay. Stated differently, at present the preferred,embodiment takes perhaps 20 seconds to recover each 100 ms of loop time. If, for example, the frequency differential between the X1 and X2 clock rates were doubled, it would take only about 10 seconds to recover each 100 ms of loop time. These values are approximate, and are presented here to promote a better understanding of the workings of the present invention. Different component Values and component tolerances can of course be used to produce different results.

In FIG. 3B, switches SW1 and SW2 are separate six-position switches implemented using a diode binary coded decimal ("BCD") matrix. The relevant diodes D1–D8 are coupled to the BCD address ports on U1 and U2.

U1 and U2 operate at a sample rate of 8 KHz and include a digital to analog ("D/A") converter that converts the digitally stored synthesized sounds into analog waveforms. Because the U1 and U2 outputs will include D/A transients, low pass filters comprising U3A–U3B are provided to smooth the output sound components. Implemented with LM 324 integrated circuits, the left and right channel low pass filters each have a cut-off frequency of about 3.5 KHz. The filtered audio from the low pass filters may be independently attenuated with potentiometers VR1 and VR2, and is passed to the summing audio amplifier module 40.

Figure 4A:
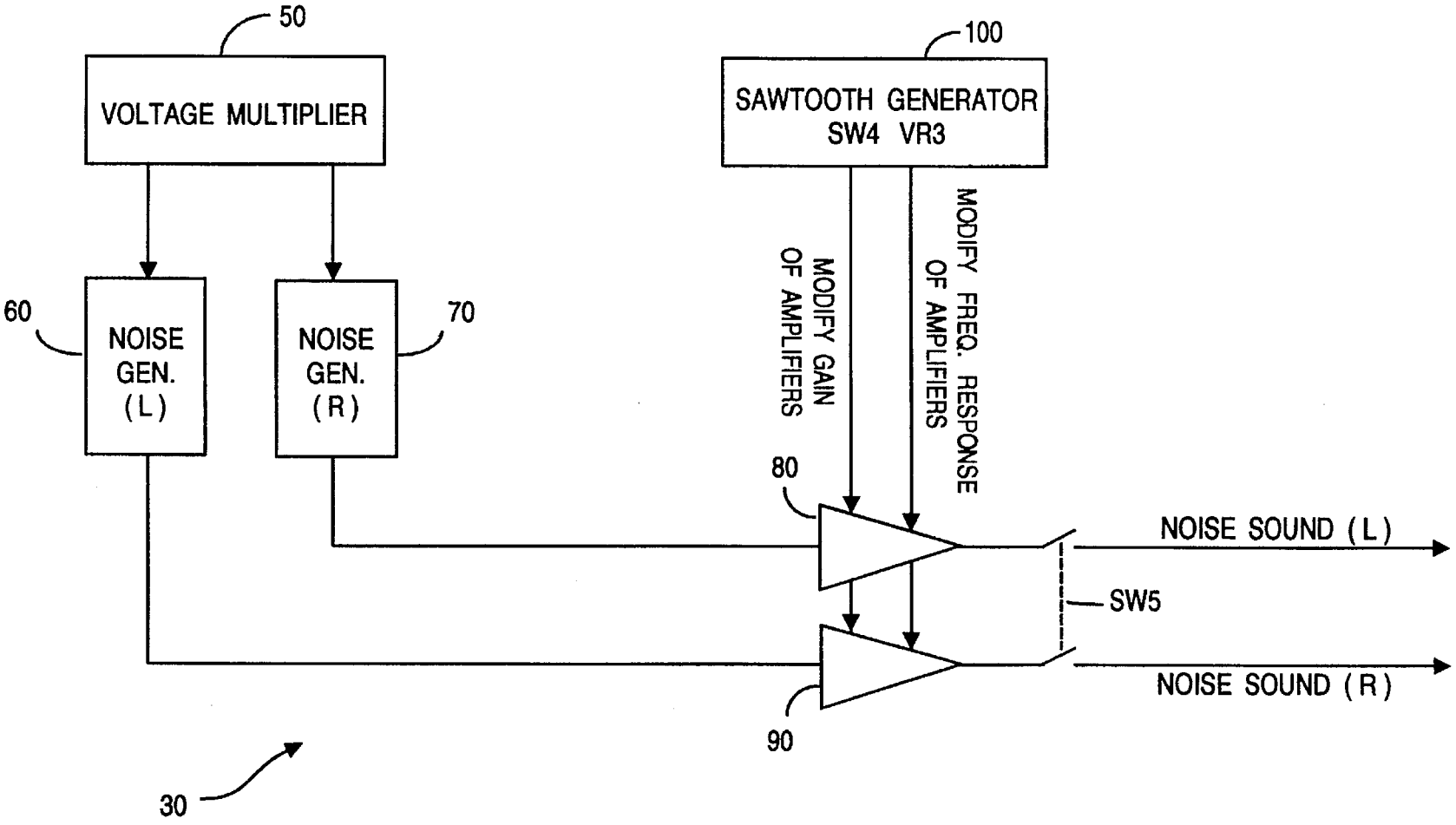
FIG. 4A is a block diagram of a dual-output modulatable noise generator, according to the present invention.

FIG. 4A is a block diagram of module 30. Module 30 provides two independent substantially identical white noise generators 60 and 70, whose separate left and right channel outputs may be modulated by a single sawtooth modulator 100. By "substantially identical" it is meant that although generators 60 and 70 are each implemented with the same type transistors, same value resistors and the like, their two spectral outputs will nonetheless be somewhat different. (Module 30 thus differs from module 20, wherein U1 and U2 each contain loops of identical sounds.)

Applicant has discovered that a user listening to left and right channels of independently generated noise sound (e.g., noise from generators 60 and 70) will perceive a greatly enhanced depth of sound and will experience enhanced spatial separation. This enhanced sensation appears to occur because at any given moment, each independent generator 60 and 70 will output different spectra.

This result is somewhat surprising because it has long been assumed that all white noise is the same and will always have the same white noise audio characteristics. Experiments by applicant have shown that the prior art approach of using a single white noise generator to provide left and right channels of audio produces a rather "flat" sound sensation, as contrasted to what is produced by module 30.

Because the present invention preferably is handheld and operated from a 6 V battery, module 30 includes a voltage multiplier 50. Multiplier 50 generates perhaps +18 VDC, which higher voltage is then provided to the white noise generators 60 and 70.

The noise outputs from generators 60 and 70 are coupled as input to separate amplifiers 80 and 90. The left and right channel noise sound outputs from amplifiers 80 and 90 pass through noise ON/OFF switch SW5 and may be provided to the summing amplifier module 40. As shown in FIG. 4A, both the gain and the frequency characteristics of amplifiers 80 and 90 may be modulated by a single sawtooth generator 100. The user-controls associated with generator 100 are the WAVE/RAIN selection switch SW4, the sound effect potentiometer VR3, and the noise ON/OFF switch SW5.

Figure 4B:
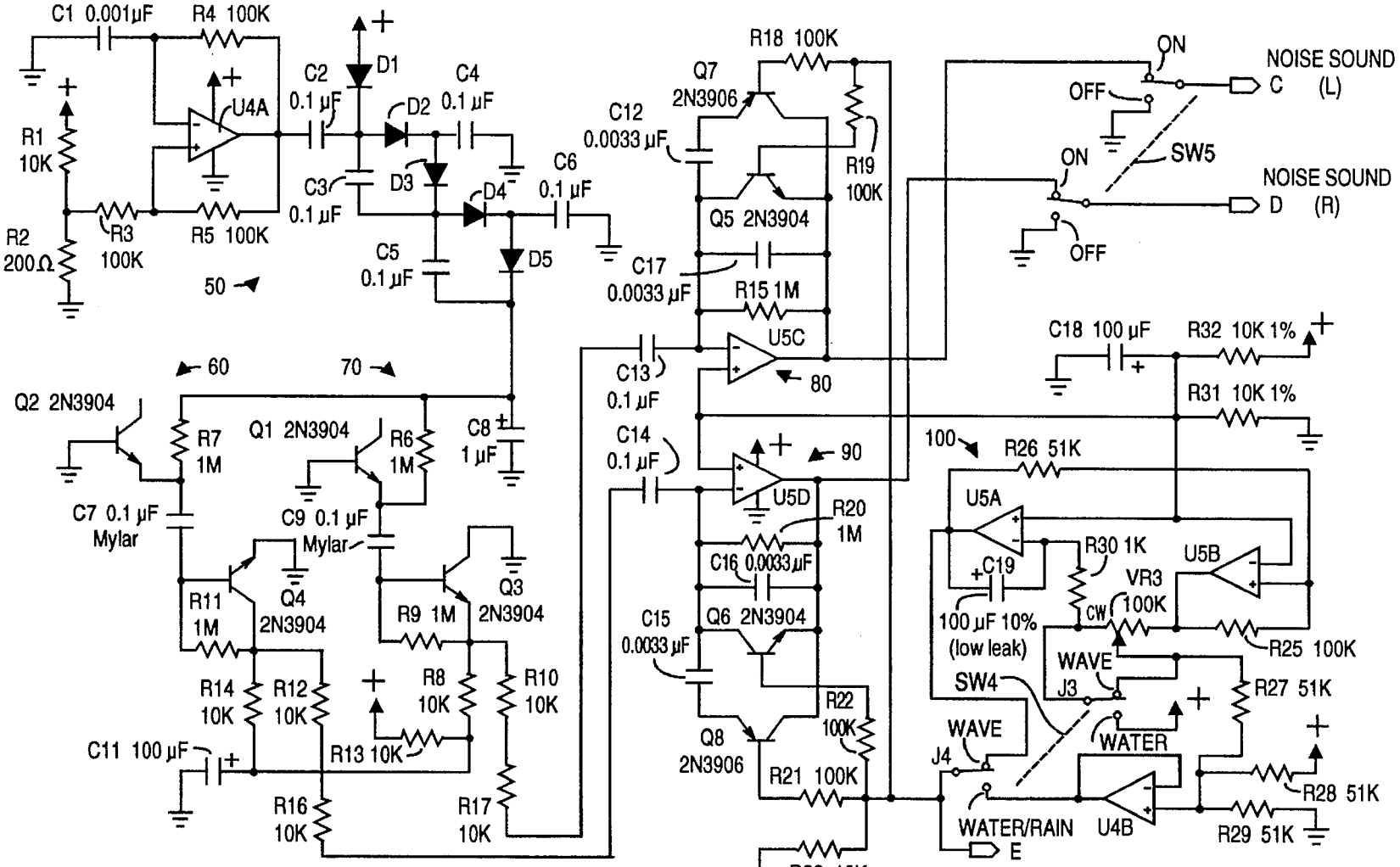
FIG. 4B is a schematic diagram of a preferred embodiment of a dual-output modulatable noise generator, according to the present invention.

Turning now to FIG. 4B, the voltage multiplier 50 comprises U4A (preferably an LM 324), diodes D1-D6 and associated components. U4A is a square-wave oscillator oscillating at perhaps 1 KHz, although the frequency is not critical. The output from U4A is AC-coupled and peak-rectified, and superimposed upon succeedingly higher DC voltages by capacitors and diodes C2–C8, D1–D6. Ultimately, the rectified voltage appearing across capacitor C8 preferably will be about +18 VDC when the battery (or other power supply) is +6 VDC. In the preferred embodiment, it suffices if the voltage across C8 exceeds about +10 VDC. However, since the operating power supply might be as low as +4 VDC. Even with a +4 VDC power source, voltage multiplier 50 will still develop at least +10 VDC across capacitor C8, permitting module 30 to continue to function.

White noise generators 60 and 70 comprise transistors Q2 and Q1 and their respective emitter resistors R7, R6. The voltage developed across capacitor C8 produces a current through resistors R7, R6, which condition causes Q1 and Q2 (preferably Motorola 2N3904 devices) to generate white noise.

The white noise generated by Q2 is AC-coupled through capacitor C7 to transistor amplifier Q4, and the white noise independently generated by Q1 is AC-coupled through capacitor C9 to transistor amplifier Q3. Preferably C7 and C9 are Mylar capacitors, to avoid microphonics in the high gain circuit shown.

The two channels of white noise are then input to left and right channel operational amplifiers U5C, U5D. U5C and U5D, like the other Operational amplifiers used in the preferred embodiment, are LM 324 integrated circuits. Whether the left and right channel noise sounds provided by U5C, U5D are coupled to the summing audio amplifier module 40 depends upon the user-selected position of NOISE ON/OFF switch SW5.

With reference to FIG. 4B, sawtooth generator 100 includes U5A and U5B and their related components, with the sawtooth waveform appearing at the output of amplifier U5A. Sawtooth generation occurs only when the WAVE/RAIN switch SW4 is in the WAVE position (as shown in FIG. 4B). When SW4 is in the WAVE position, U5A (an LM 324) along with capacitor C19 and resistors VR3 and R30 acts as an integrator. The integration sawtooth waveform (present at the output of U5A)is feedback with hysteresis to the positive input of U5B. U5B then switches the current through VR3 at a rate determined by C19, VR3 and R30.

Thus, when SW4 is in the WAVE position, a sawtooth waveform is coupled from the output of U5A to the base leads of transistors Q6, Q8, and Q7, Q5. When the sawtooth waveform is more positive than the output from amplifiers U5D, U5C, transistors Q6 and Q5 will tend to turn on. By the same token, when the sawtooth waveform is more negative than the emitters of transistors Q7 and Q8, transistors Q7 and Q8 will tend to turn on.

Referring to FIG. 4B, the frequency response of amplifiers U5C and U5D is affected by the presence of capacitors C12, C17, and C15 and C16, respectively. When transistors Q5 and Q6 are turned-on by a positive ramp voltage, capacitors C17 and C16 become shunted by Q5 and Q6, which reduces the gain of U5C and U5D. The sound heard by the user at this time will be the quiet portion of an ocean WAVE. As the sawtooth waveform reverses and reduces in magnitude, Q5 and Q6 turn off, which increases the gain of U5C and U5D, thus increasing the amplitude of the white noise passing through U5C and U5D. The user will now hear sounds emulating an ocean WAVE that is breaking.

As the sawtooth waveform continues in the negative direction, transistors Q7 and Q8 will turn-on, and couple capacitors C12 and C15 in parallel with capacitors C17 and C16. This increased capacitance will decrease the high frequency response of U5C and U5D, and will attenuate the higher frequency components of the white noise passing through U5C and U5D. The user will hear the sound of an ocean WAVE rolling under. Eventually the sawtooth will begin to go more positive, and the cycle will continue. Capacitors C12, C17, C15, C16 were determined empirically by trial and error, the values shown on FIG. 4B producing realistic sound ocean WAVE effects.

As the sawtooth modulation increases and decreases, the resultant sound will be that of an ocean WAVE building up and then decreasing in intensity. By varying the sawtooth repetition rate with potentiometer VR3, the user can change the repetition rate of the ocean WAVE sounds. In the preferred embodiment, this rate may be varied almost 100:1, from about 1 cycle every 22 seconds (e.g., 0.045 Hz) to about 3 cycles per second (3 Hz).

Consider now what occurs when the user puts SW4 in the RAIN position. The output of U5A is disconnected from the base leads of transistors Q5, Q7, Q6, Q8, and in fact with +5 VDC now coupled to its inverting input, U5A will saturate at 0 V output. This 0 V output signal from U5A is coupled to the non-inverting input of U5B, which voltage will force the output of U5B to ground. Simply stated, the configuration shown in FIG. 4B serves to impress a 0 VDC to +5 VDC range upon potentiometer VR3 when SW4 is in the RAIN position.

As potentiometer VR3 is varied, the user can now manually perform the role of the sawtooth waveform that is generated when SW4 was in the WAVE position. Resistors R27, R28, R29 divide down the VR3-varied DC voltage, and U4B serves as a voltage follower. In the RAIN position, the user can manually select a VR3 position to produce continually any noise sound heard, dynamically, when VR3 was in the WAVE position. In practice, with SW4 in the RAIN position, the user can manually adjust VR3 to select sounds that range from lightly falling rain to a rushing waterfall sound.

Figure 5:
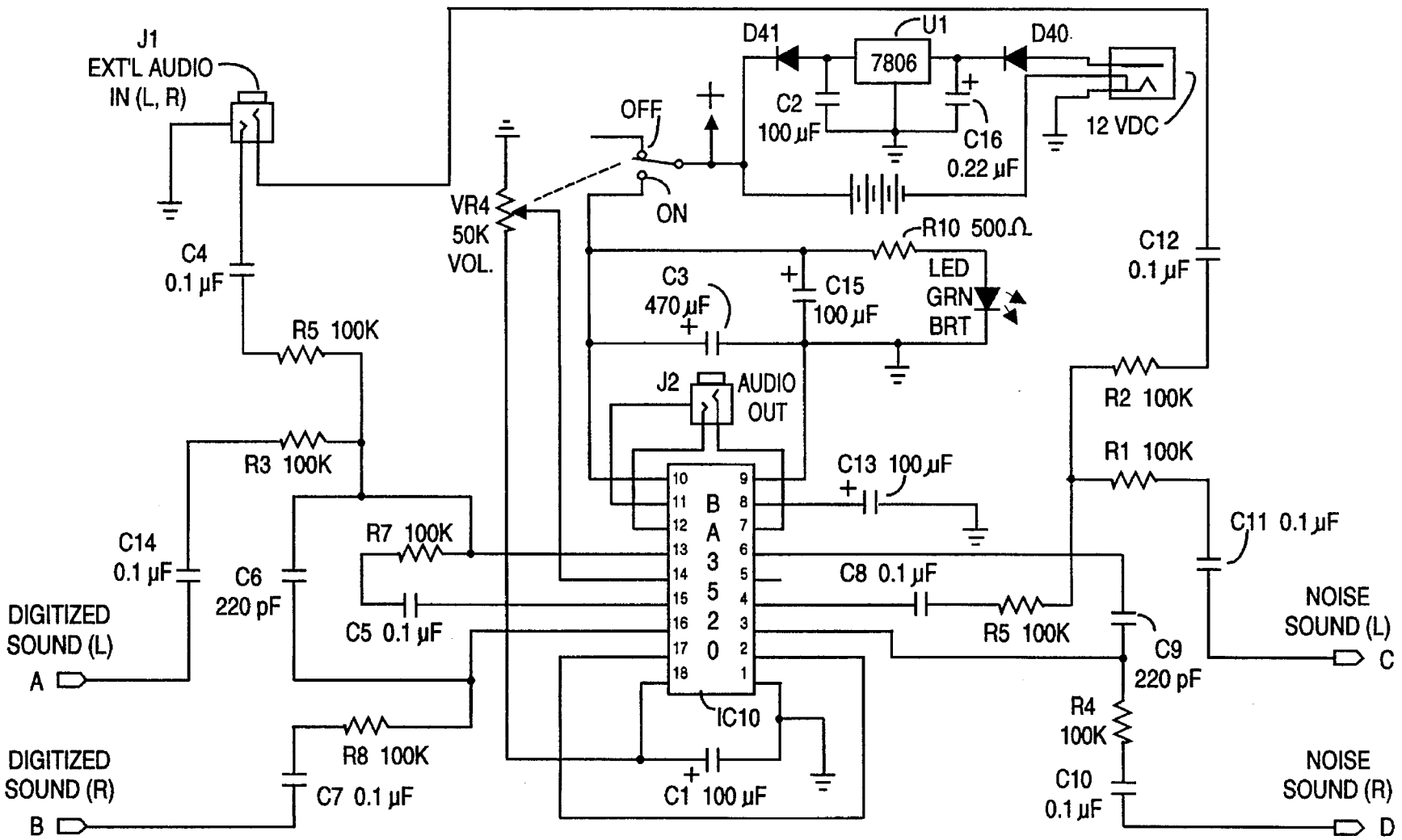
FIG. 5 is a schematic diagram of the preferred embodiment of a summing audio amplifier for use with the present invention.

FIG. 5 is a schematic of the summing audio amplifier module 40 used with the present invention. As shown therein, left channel and the right channel of digitized sound from module 20, are respectively summed with the left channel and the right channel of noise-generated sound from module 30, and with any externally input sound channels present at external jack J1. Integrated circuit IC10, a BA 3520 earphone driver, then outputs an amplified version of the summed-together left channels, and summed-together right channels of audio. The two output audio channels are coupled to audio output jack J2 for listening by the user, preferably with stereo earphones. As noted, master volume control VR4 controls the output volume of all signals passing through IC10, and is connected to a power ON/OFF switch for unit 10.

The present invention has been described with respect to a preferred embodiment that provides two independent synthesizer IC sound generators, and two independent white noise generators. While either embodiment of the present invention may be practiced on a stand-alone basis, there are advantages to combining modules 20 and 30 within a single unit 10.

Because the present invention does include modules 20 and 30, the user may combine sounds from each module to create new sounds. For example, SW1 and/or SW2 may be switched to OCEAN, and at the same time SW4 and SW5 can cause white-noise generated WAVE sounds to be heard as well. Similarly, SW1 and/or SW2 can select the sound of a bubbling BROOK, while simultaneously SW4 and SW5 cause white-noise generated RAIN sounds to be generated, to produce a new sound. The present invention can also combine externally generated sound with sound generated by unit 10. For example, a user who is a passenger on an airline may wish to input the airline audio through input jack J1, and then listen to a combination of the airline audio and sound generated by unit 10. The result can be very relaxing in that unit 10-generated sounds can mask the ambient noise in the cabin, permitting easier listening to the airline audio. If the user wishes to go to sleep, the airline audio can be unplugged from jack J1, leaving only the sounds generated by unit 10.

Modifications and variations may be made to the disclosed embodiments without departing from the subject and spirit of the invention as defined by the following claims.

What is claimed is:

1. An electronic system for generating sound on a first sound channel and on a second sound channel, comprising:

a resettable first generator outputting, when not in a reset mode, a first loop of stored sound at a first clock rate to said first sound channel;

a resettable second generator outputting, when not in a reset mode, a continuous second loop of stored sound at a second clock rate to said second sound channel;

said second generator being configured to exit reset mode and thus begin to output said second loop a ΔRESET time sooner than said first generator exits reset mode and begins to output said first loop; and a mode switch coupled to said first generator and to said second generator;

said mode switch providing at least one mode configuration selected from the group consisting of (i) a lock configuration in which said first clock rate and said second clock rate are equal, and (ii) an unlock configuration in which said first clock rate and said second clock rate differ;

wherein user-perceived spatial separation of sound generated by said system may be changed with said mode switch.

2. The system of claim 1, wherein:

said mode switch has a reset configuration in which each said generator is held in said reset mode; said mode switch has said lock configuration; and said mode switch has said unlock configuration;

said first loop of stored sound and said second loop of stored sound are each an continuous identical loop of stored sound;

when said mode switch is switched from said reset configuration to said lock configuration, start of output of said continuous identical loop on said first sound channel output is delayed by approximately said ΔRESET time from start of output of said continuous identical loop on said second sound channel; and when said mode switch is switched from said reset configuration to said unlock configuration, initially start of output of said continuous identical loop on said first sound channel output is delayed by approximately said ΔRESET time from start of output of said continuous identical loop on said second sound channel but thereafter relative time separating start of said continuous identical loop on each said sound channel drifts due to said first clock rate differing from said second clock rate.

3. The system of claim 1, wherein when said mode switch is in said unlock position, said first clock rate has a higher frequency than said second clock rate.

4. The system of claim 1, wherein said mode switch includes a reset configuration in which each said generator is held in said reset mode.

5. The system of claim 1, wherein said first generator and said second generator are each an identical integrated circuit that stores an identical library of at least two user-selectable continuous sound loops.

6. The system of claim 5, wherein said identical library includes at least two continuous sound loops selected from the group consisting of (i) an ocean sound, (ii) a rain sound, (iii) a country sound, (iv) a brook sound, (v) a waterfall sound, and (vi) a beating heart sound.

7. The system of claim 1, further including a first noise generator outputting first noise-generated sound to said first sound channel, and a second noise generator outputting second noise-generated sound to said second sound channel.

8. The system of claim 7, further including a modulator that simultaneously modulates said first noise-generated sound on said first sound channel and said second noise-generated sound on said second sound channel.

9. The system of claim 8, wherein said modulator includes a modulation mode switch that in one configuration causes said modulator to provide a sawtooth modulation at a repetition rate governed by a user-operated control, and that in a second configuration causes said modulator to provide a DC modulation at an amplitude that is governed by said user-operated control.

10. An electronic system for generating sound over a first sound channel and a second sound channel, comprising:

a first noise generator outputting first noise-generated sound to said first sound channel;

a second noise generator outputting second noise-generated sound to said second sound channel;

a modulator that simultaneously modulates said first noise-generated sound on said first sound channel and said second noise-generated sound on said second sound channel; and a modulation mode switch that in a first configuration causes said modulator to provide a sawtooth modulation at a repetition rate governed by a user-operated control, and that in a second configuration causes said modulator to provide a DC modulation at an amplitude that is governed by said user-operated control.

11. The system of claim 10, wherein said mode switch has a reset configuration in which each said generator is held in said reset mode.

12. The system of claim 10, further including:

a resettable first integrated circuit storing a library of continuous loops of sound and outputting, when not in a reset mode, a user-selected first sound loop from said library at a first clock rate to said first sound channel;

a resettable second integrated circuit, identical to said first integrated circuit, storing an identical said library of continuous loops of sound and outputting, when not in a reset mode, a user-selected second sound loop from said library at a second clock rate to said second sound channel;

said second integrated circuit being configured to exit reset mode and thus begin to output said second loop a ΔRESET time sooner than said first integrated circuit exits reset mode and begins to output said first loop;

a mode switch, coupled to said first integrated circuit and to said second integrated circuit, that changes user-perceived spatial separation of sound generated by said first and second integrated circuit;

said mode switch having at least one configuration selected from the group consisting of (i) a lock configuration in which said first clock rate and said second clock rate are equal, and (ii) an unlock configuration in which said first clock rate and said second clock rate differ.

13. An electronic system for generating sound on a first sound channel and on a second sound channel, comprising:

a resettable first integrated circuit generator outputting, when not in a reset mode, a first loop of stored sound at a first clock rate to said first sound channel;

a resettable second integrated circuit generator, identical to said first integrated circuit generator, outputting, when not in a reset mode, a continuous second loop of stored sound at a second clock rate to said second sound channel;

said second generator being configured to exit reset mode and thus begin to output said second loop a ΔRESET time sooner than said first generator exits reset mode and begins to output said first loop;

a mode switch, coupled to said first generator and to said second generator, that changes user-perceived spatial separation of sound generated by said first and second integrated circuit;

said mode switch having at least one configuration selected from the group consisting of (i) a lock configuration in which said first clock rate and said second clock rate are equal, and (ii) an unlock configuration in which said first clock rate and said second clock rate differ;

a first noise generator outputting first noise-generated sound to said first sound channel;

a second noise generator outputting second noise-generated sound to said second sound channel; and a modulator that simultaneously modulates said first noise-generated sound on said first sound channel and said second noise-generated sound on said second sound channel;

wherein a user of said electron system may select and hear sound generated by a chosen combination of said first integrated circuit, said second integrated circuit, said first noise generator, and said second noise generator.

14. The system of claim 13, wherein when said mode switch is in said unlock configuration, said first clock rate has a higher frequency than said second clock rate.

15. The system of claim 13, wherein said first integrated circuit generator and said second integrated circuit generator each store an identical library of at least two continuous sound loops, said mode switch has a reset configuration in which each said generator is held in said reset mode, said system further including:

a first user-operable sound-select switch coupled to said first integrated circuit generator, said switch allowing a user of said system to select a chosen one of said library of continuous sound loops to be output by said first integrated circuit generator;

a second user-operable sound-select switch coupled to said first integrated circuit generator, said switch allowing a user of said system to select a chosen one of said library of continuous sound loops to be output by said second integrated circuit generator;

wherein when said first user-operable sound-select switch and said second user-operate sound-select switch select an identical said continuous sound loop, when said mode switch is switched from said reset configuration to said lock configuration, start of output of said continuous identical loop on said first sound channel output is delayed by approximately said ΔRESET time from start of output of said continuous identical loop on said second sound channel; and when said mode switch is switched from said reset configuration to said unlock configuration, initially start of output of said continuous identical loop on said first sound channel output is delayed by approximately said ΔRESET time from start of output of said continuous identical loop on said second sound channel but thereafter relative time separating start of said continuous identical loop on each said sound channel drifts due to said first clock rate differing from said second clock rate.

16. The system of claim 15, wherein said identical library includes at least two continuous sound loops selected from the group consisting of (i) an ocean sound, (ii) a rain sound, (iii) a country sound, (iv) a brook sound, (v) a waterfall sound, and (vi) a beating heart sound.

17. A method for generating sound having user-perceived spatial separation on a first sound channel and on a second sound channel, the method including the following steps:

outputting after a ΔRESET time, when not in a reset mode, a first loop of stored sound at a first clock rate to said first sound channel;

outputting, when not in a reset mode, a continuous second loop of stored sound at a second clock rate to said second sound channel;

a beginning of said first loop being output approximately said ΔRESET time after a beginning of said second loop is output, upon exiting said reset mode;

providing a mode function, including at least one mode selected from the group consisting of (i) a lock mode in which said first clock rate and said second clock rate are equal, and (ii) an unlock mode in which said first clock rate and said second clock rate differ;

wherein user-perceived spatial separation of sound generated by said system may be changed by said mode function.

18. The method of claim 17, further including the steps of providing a first noise generator outputting first noise-generated sound to said first sound channel, and a second noise generator outputting second noise-generated sound to said second sound channel.

19. The method of claim 17, wherein said mode function has a reset mode in which each said generator is held in said reset mode, and said first loop of stored sound and said second loop of stored sound are each an continuous identical loop of stored sound;

wherein when said mode function changes from said reset mode to said lock mode, start of output of said continuous identical loop on said first sound channel output is delayed by approximately said ΔRESET time from start of output of said continuous identical loop on said second sound channel; and when said mode function changes from said reset mode to said unlock mode, initially start of output of said continuous identical loop on said first sound channel output is delayed by approximately said ΔRESET time from start of output of said continuous identical loop on said second sound channel but thereafter relative time separating start of said continuous identical loop on each said sound channel drifts due to said first clock rate differing from said second clock rate.

20. The method of claim 19, wherein said a system demonstration mode is provided in said unlock mode by providing a said first clock rate having a higher frequency than said second clock rate;

a said generated sound having a sound-migration effect upon a user within a predictable amount of time after changing from said reset mode to said unlock mode.

* * * * *